US009404703B2

(12) United States Patent
Zou

(10) Patent No.: US 9,404,703 B2
(45) Date of Patent: Aug. 2, 2016

(54) BULLET FEEDING AND POSITIONING DEVICE FOR TOY GUN

(71) Applicant: Zhuo-Wei Zou, New Taipei (TW)

(72) Inventor: Zhuo-Wei Zou, New Taipei (TW)

( * ) Notice: Subject to any disclaimer, the term of this patent is extended or adjusted under 35 U.S.C. 154(b) by 0 days.

(21) Appl. No.: 14/886,100

(22) Filed: Oct. 19, 2015

(65) Prior Publication Data

US 2016/0116244 A1 Apr. 28, 2016

(30) Foreign Application Priority Data

Oct. 24, 2014 (TW) ..... 103218865 U

(51) Int. Cl.

| | |
|---|---|
| ***F41B 11/00*** | (2013.01) |
| ***F41A 21/18*** | (2006.01) |
| ***F41B 11/89*** | (2013.01) |
| ***F41B 7/08*** | (2006.01) |
| ***F41B 11/70*** | (2013.01) |

(52) U.S. Cl.

CPC . *F41A 21/18* (2013.01); *F41B 7/08* (2013.01); *F41B 11/00* (2013.01); *F41B 11/70* (2013.01); *F41B 11/89* (2013.01)

(58) Field of Classification Search

CPC ..... F41B 11/00; F41B 11/70; F41B 11/73

See application file for complete search history.

(56) References Cited

U.S. PATENT DOCUMENTS

| | | | | |
|---|---|---|---|---|
| 5,655,510 | A * | 8/1997 | Kunimoto | F41B 11/00 124/73 |
| 7,603,998 | B2 * | 10/2009 | Finstad | F41B 11/00 124/73 |
| 7,699,048 | B2 * | 4/2010 | Finstad | F41A 21/32 124/81 |
| 9,103,624 | B1 * | 8/2015 | Kung | F41B 11/62 |
| 2001/0032638 | A1 * | 10/2001 | Yoshimura | F41A 21/00 124/81 |
| 2015/0226519 | A1 * | 8/2015 | Hsu | F41B 11/70 124/82 |

* cited by examiner

*Primary Examiner* — John Ricci

(57) ABSTRACT

A feeding and positioning device for toy gun comprises a barrel and a friction cylinder. The barrel has a bore, a convex hole, and a guiding groove. Two groove sides are formed at two sides of the guiding groove with circular cone shape. A width and a depth of the guiding groove are gradually decreased from the first end of the barrel inwardly. The friction cylinder has a hollow and elastic cylinder body covered at the first end of the barrel and a friction portion arranged inside the cylinder portion and inserted into the convex hole inwardly. The bullet is aligned by the groove sides and then cooperated with the friction portion to form three-point guiding position to downwardly press the bullet to be precisely fed. It may prevent the bullet from skewed error and improve the range of firing, effective potential energy, and hit rate.

6 Claims, 10 Drawing Sheets

BULLET FEEDING AND POSITIONING DEVICE FOR TOY GUN

BACKGROUND OF THE INVENTION

1. Field of the Invention

The present invention relates to a feeding and positioning device for toy gun, and especially relates to a feeding and positioning device for BB gun.

2. Description of Related Art

Normally, the cone-shaped bullet is using the peeling of the spiral rifling while shooting to rotate by its own longitudinal axis after firing. The surface of the bullet is slantwise pressed to decrease the air resistance and further to improve the range of firing and hit rate.

However, there is no spiral rifling in the BB gun (toy gun). Please refer to FIG. 1, BB bullet 95 may only use the friction member 93 arranged inside the bore 92 to produce friction by pressing unidirectional. The BB bullet 95 may be rotated by its own longitudinal axis and the friction member 93 may be used for first positioning before shooting. The pressure outputted from the firing system may push the BB bullet 95 to prevent the air resistance and improve the range of firing after shooting.

But the friction member 93 arranged inside the barrel 91 of the BB gun (toy gun) is unidirectionally blocking the BB bullet 95 and the BB bullet 95 is contacted with an inner peripheral of the bore 92 with one point. Therefore, the error is easily produced while the bullet 95 is pushed by the nozzle 94 to be positioned before shooting, and the error of the positioning point of the BB bullet 95 is easier produced. It is hard to ensure that the BB bullet 95 may be pushed by instant high pressure in every firing. And the friction member 93 may not relatively effectively press BB bullet 95 slantwise. The BB bullet 95 may be shifted after firing and the rotation may be relatively decreased. The range of firing may be decreased. And the potential energy may be further decreased due to the decreasing of speed. The hit rate may be also influenced.

In view of the foregoing circumstances, the inventor has invested a lot of time to study the relevant knowledge, compare the pros and cons, research and develop related products. After quite many experiments and tests, the "feeding and positioning device for toy gun" of this invention is eventually launched to improve the foregoing shortcomings, to meet the public use.

SUMMARY OF THE INVENTION

An object of this invention is providing a feeding and positioning device for toy gun to improve the drawbacks of the prior art. The bullet is aligned by the groove sides respectively arranged at two sides of the guiding groove with circular cone shape and then cooperated with the friction portion to form three-point guiding position to downwardly press the bullet to be precisely fed. It may prevent the bullet from skewed error and improve the range of firing, effective potential energy, and hit rate.

In order to improve above mentioned drawbacks, a feeding and positioning device for toy gun is provided. The feeding and positioning device for toy gun may comprise: a barrel, having a bore, a convex hole, and a guiding groove, two ends of the bore are communicated with each other and for guiding a bullet, the convex hole is arranged at a first end of an outer surface of the barrel and communicated with the bore, the guiding groove is convexly arranged at a bottom surface of the bore and axially extended, two groove sides are formed at two sides of the guiding groove, a width and a depth of the guiding groove are gradually decreased from the first end of the barrel inwardly so that the bullet is aligned by the groove sides of the guiding groove; and a friction cylinder, having a hollow and elastic cylinder body and a friction portion, the cylinder body is covered at the first end of the barrel, the friction portion is arranged inside the cylinder portion and inserted into the convex hole of the barrel inwardly so that the friction portion is controlled to press the bullet slantwise.

In some embodiments, a cross section of the guiding groove is arc shape.

In some embodiments, a positioning protrusion portion is arranged between an inner portion of the friction cylinder adjacent to the first end of the barrel and the friction portion, and the positioning protrusion portion is inserted into the convex hole and the bore inwardly so as to press the bullet downwardly.

In some embodiments, two sides of the positioning protrusion portion of the friction cylinder are convex.

In some embodiments, two embedding grooves are respectively arranged at an outer surface of two sides of the first end of the barrel and axially extended, and a plurality of embedding strings is arranged inside the friction cylinder and corresponding to each embedding groove.

In some embodiments, a radial ring groove is arranged at one end of each embedding groove opposite to the first end of the barrel, and an inner convex ring is arranged at the friction cylinder and corresponding to the radial ring groove.

The various objectives and advantages of the present invention will be more readily understood from the following detailed description when read in conjunction with the appended drawing.

DETAILED DESCRIPTION OF THE INVENTION

Figure 1:
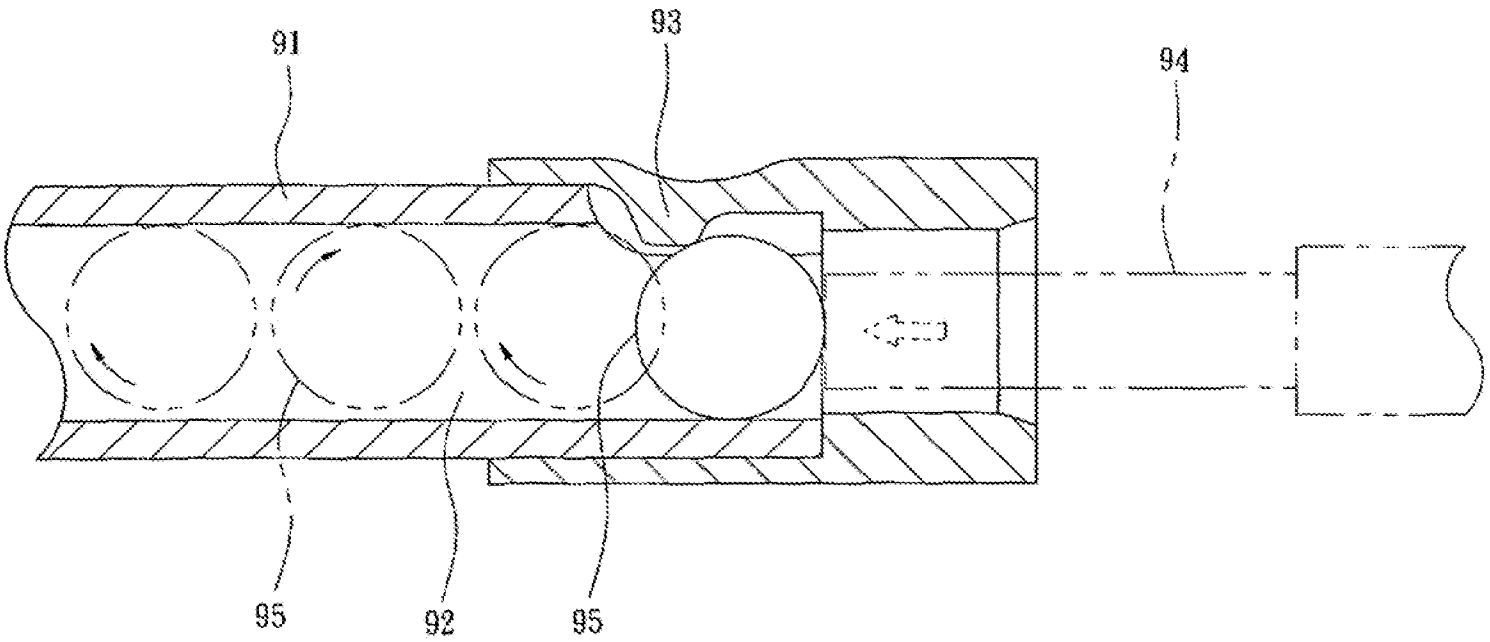
FIG.1 (Prior art)
FIG. 1 is a perspective view of a conventional BB toy gun while feeding a bullet.
Figure 2:
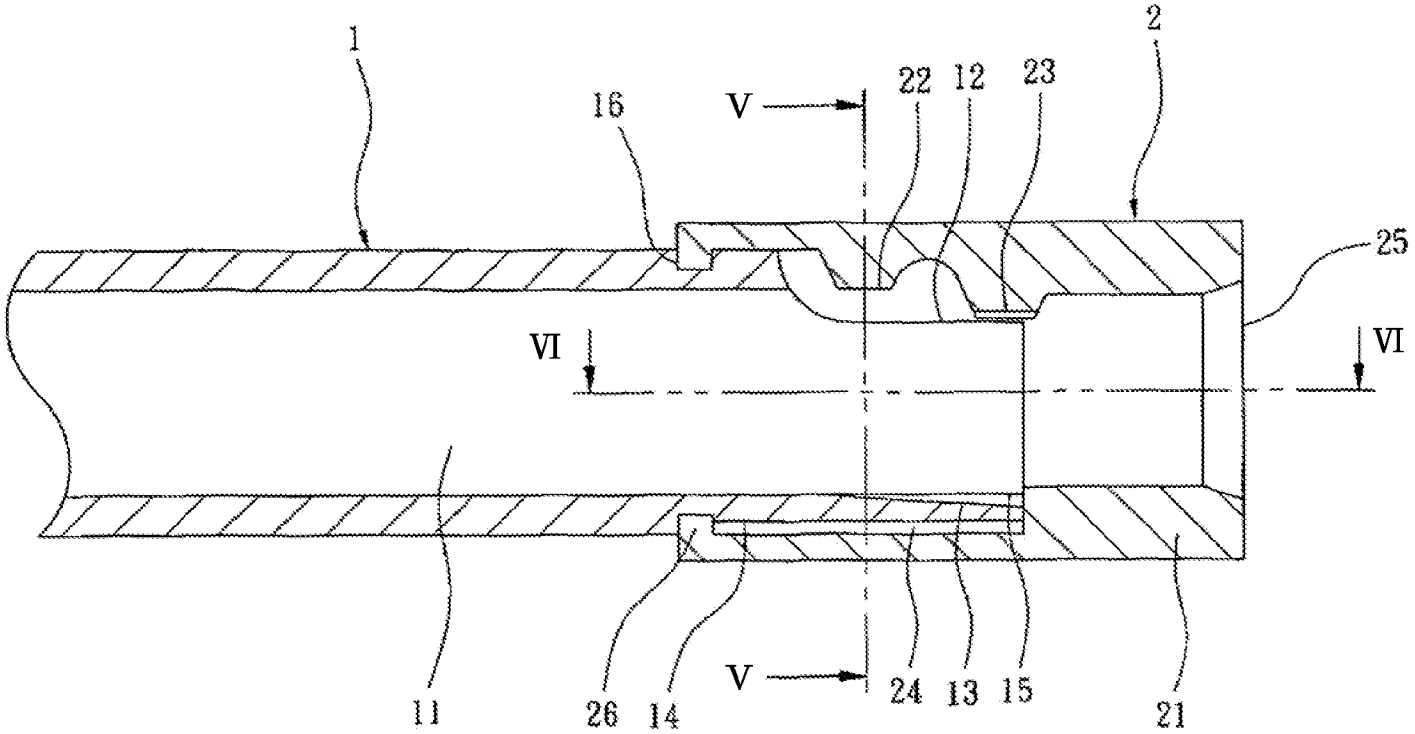
FIG. 2 is a structure diagram of a feeding and positioning device for toy gun of the present invention.
Figure 3:
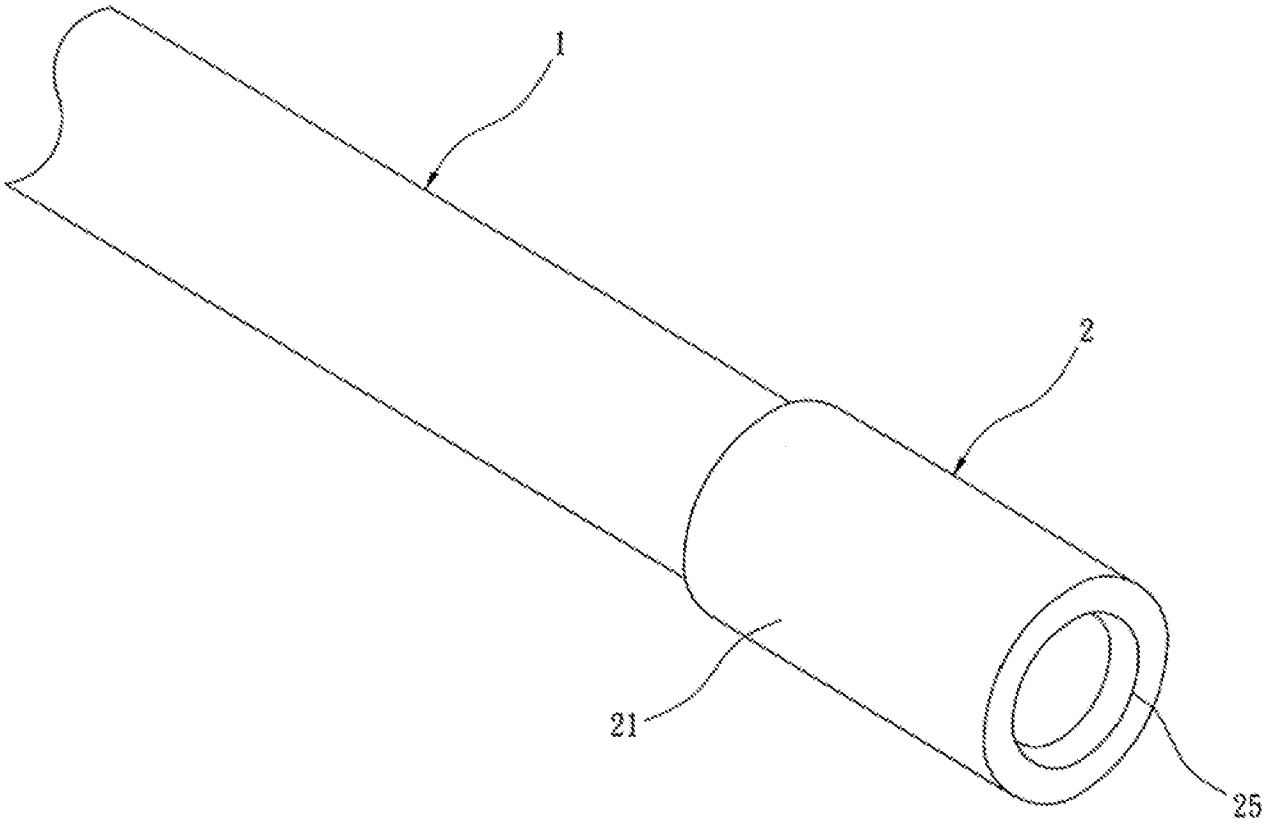
FIG. 3 is a perspective view of the feeding and positioning device for toy gun of the present invention.
Figure 4:
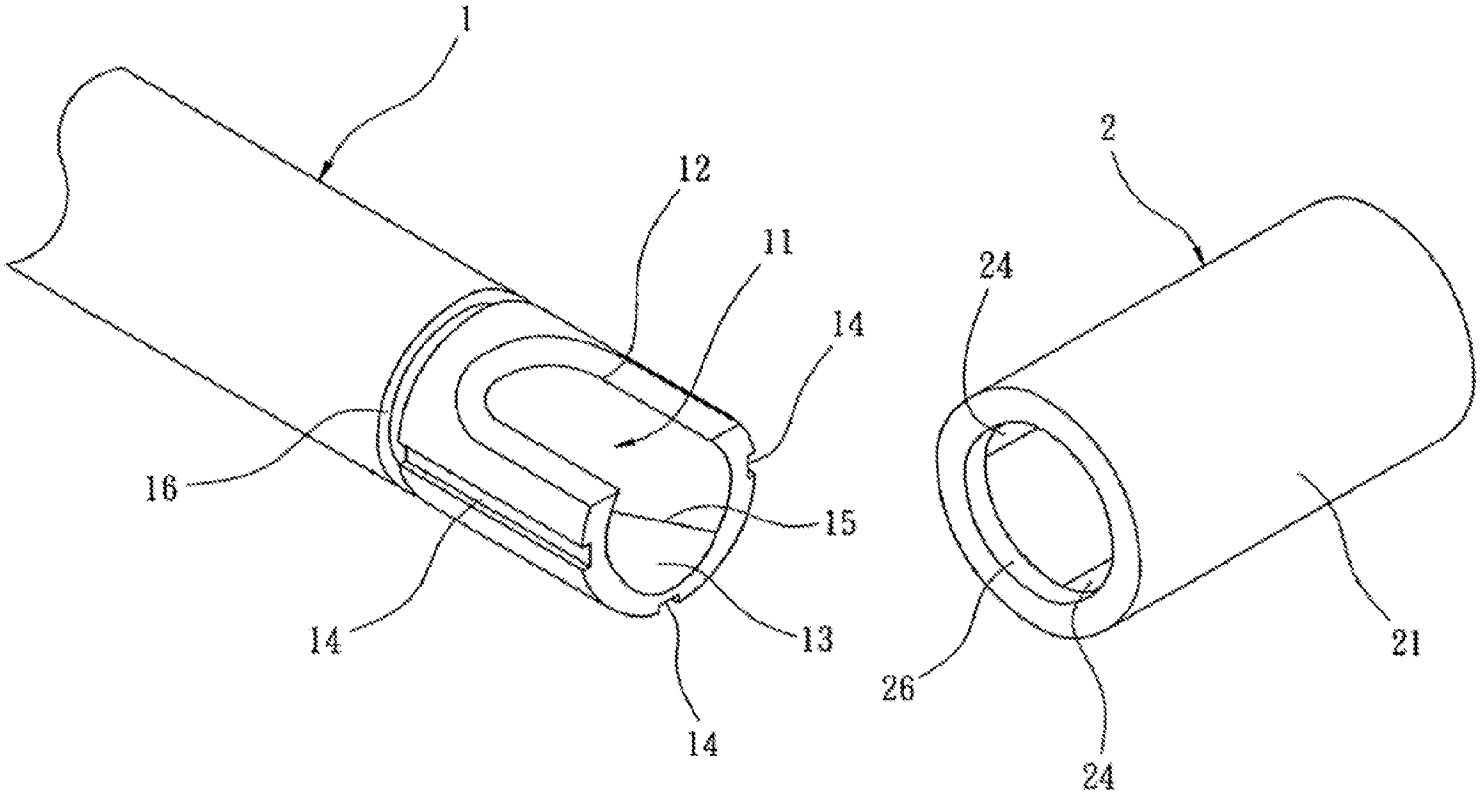
FIG. 4 is an exploded view of the feeding and positioning device for toy gun of the present invention.
Figure 5:
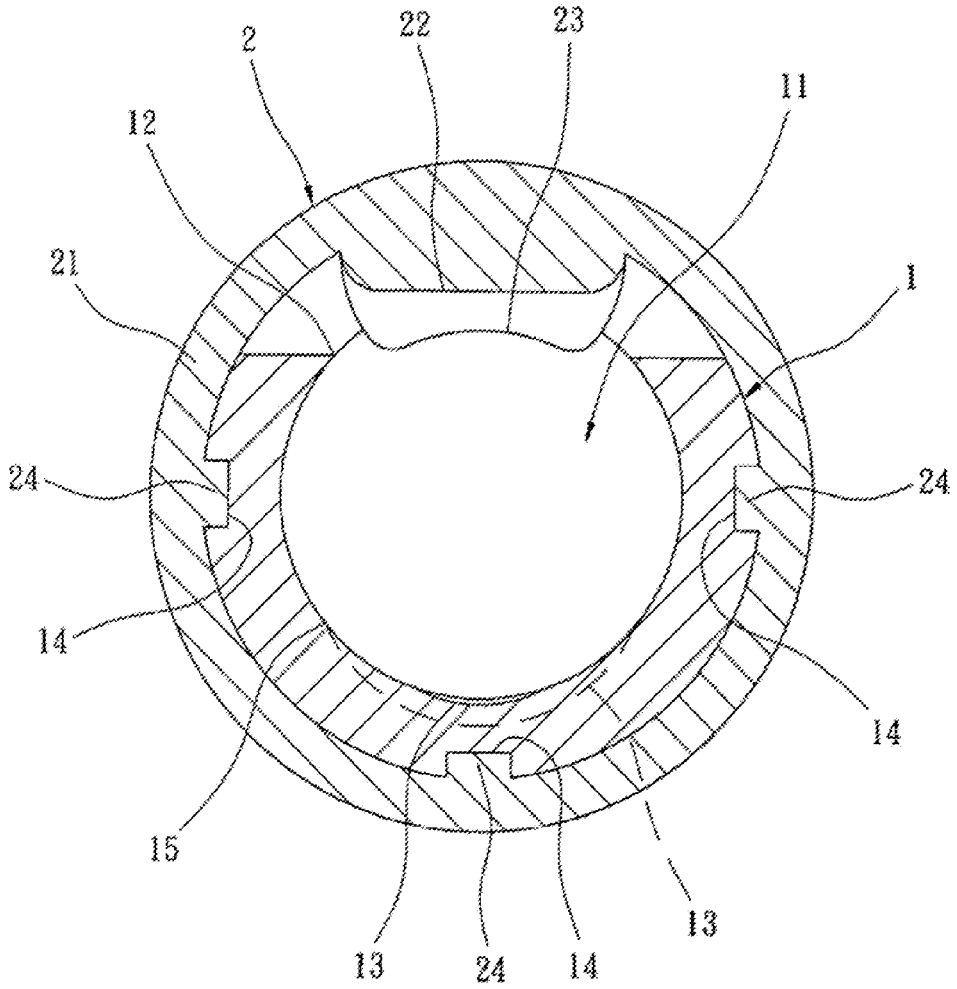
FIG. 5 is a cross-sectional view of FIG. 2 along line A-A.
Figure 6:
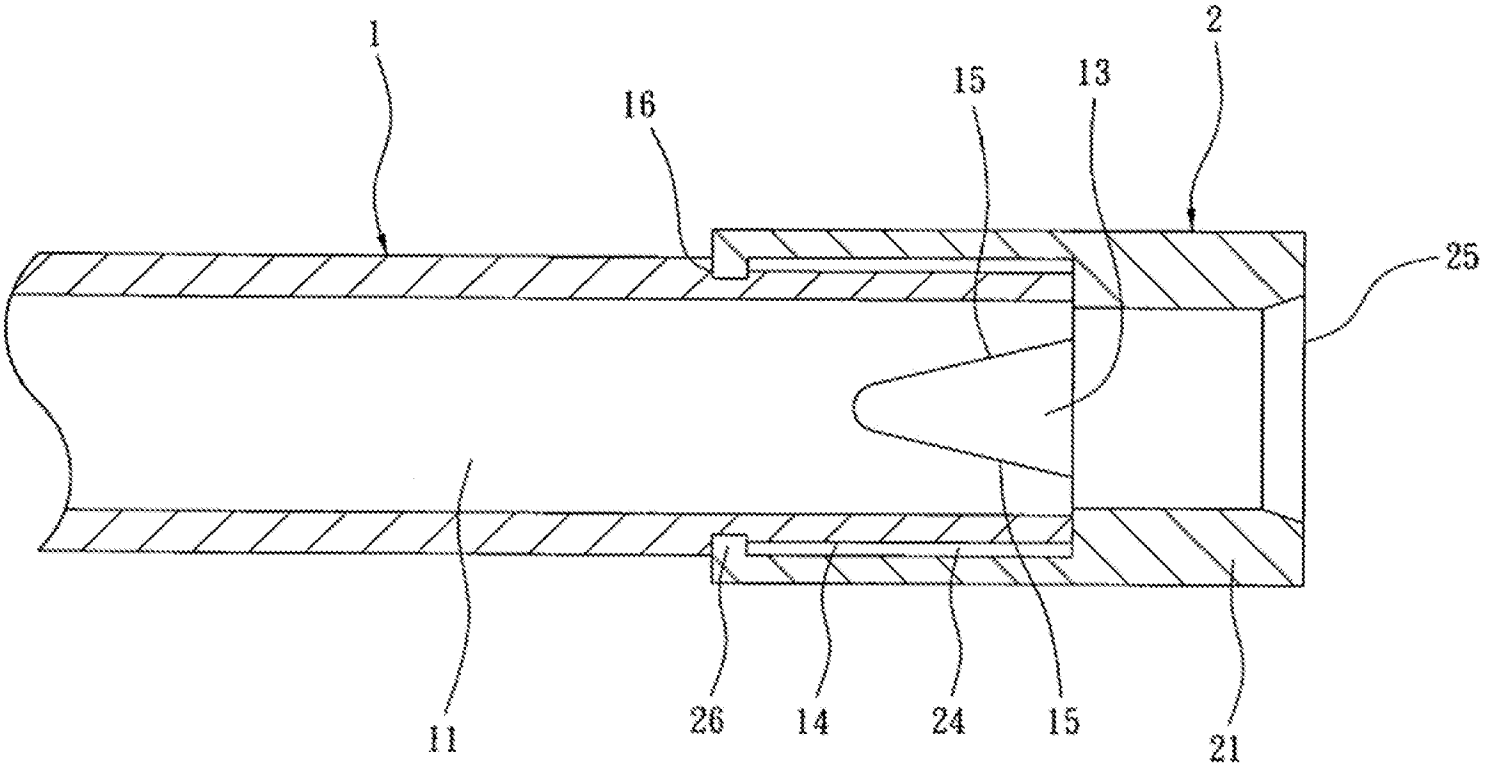
FIG. 6 is a cross-sectional view of FIG. 2 along line B-B.

To describe clearly that the present invention achieves the foregoing objective and function, the technical features and desired function are described with reference to a preferred embodiment and accompanying drawings.

Please reference to FIGS. 2 to 7, a feeding and positioning device for toy gun of the present invention mainly comprises a barrel 1 and a friction cylinder 2 so that a nozzle 3 may push bullets 4 (such as BB bullets) to be feed (shown as in FIG. 7) and then to be fired.

The barrel 1 may have a bore 11, a convex hole 12, and a guiding groove 13. Two ends of the bore 11 may be communicated with each other and for guiding a bullet 4. The convex hole 12 may be arranged at a first end of an outer surface of the barrel 1 and communicated with the bore 12. The guiding groove 13 with a circular cone shape may be convexly arranged at a bottom surface of the bore 11 and axially extended. Please refer to FIGS. 2, 5, and 7, two groove sides 15 may be formed at two sides of the guiding groove 13. A width and a depth of the guiding groove 13 are gradually decreased from the first end of the barrel 1 inwardly and a cross section of the guiding groove 13 is arc shape so that the bullet 4 is aligned by the groove sides 15 of the guiding groove 13. Two embedding grooves 14 may be respectively arranged at an outer surface of two sides of the first end of the barrel 1 and axially extended, and a radial ring groove 16 may be arranged at one end of each embedding groove 14 opposite to the first end of the barrel 1.

The friction cylinder 2 may have a hollow and elastic cylinder body 21 and a friction portion 22. The cylinder body 21 may be covered at the first end of the barrel 1. The friction portion 22 may be arranged inside the cylinder portion 21 and inserted into the convex hole 12 of the barrel 1 inwardly and a plurality of embedding strings 24 may be arranged inside the friction cylinder 2 and corresponding to each embedding groove 14. An inner convex ring 26 may be arranged at the friction cylinder 2 and corresponding to the radial ring groove 16. A positioning protrusion portion 23 may be arranged between an inner portion of the friction cylinder 2 adjacent to the first end of the barrel 1 and the friction portion 22 so that the positioning protrusion portion 23 is inserted into the convex hole 12 and the bore 11 inwardly and then downwardly press a rear section of the bullet 4 adjacent to the first end of the barrel 1 and the friction portion 23 is controlled to slantwise press a front section of the bullet 4 opposite to the rear section.

Figure 7:
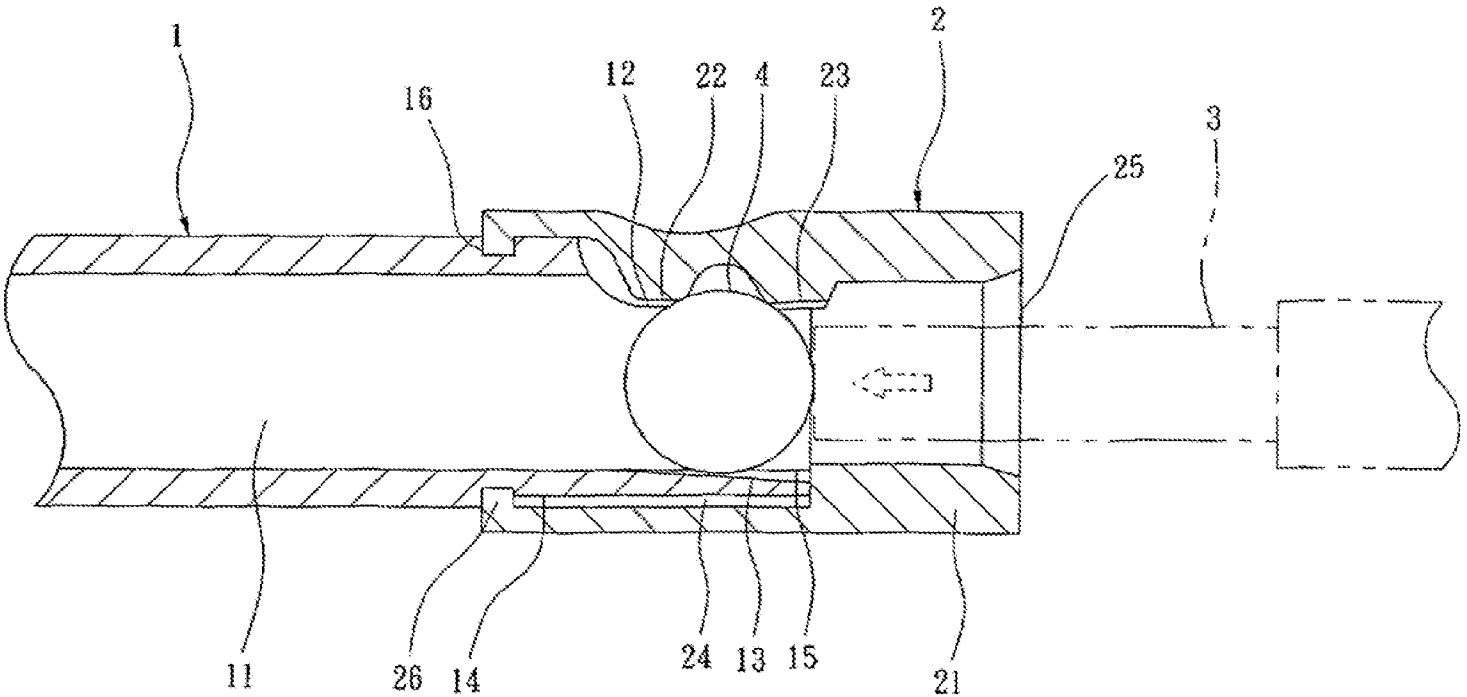
FIG. 7 is a schematic diagram of FIG. 2 while feeding a bullet.
Figure 8:
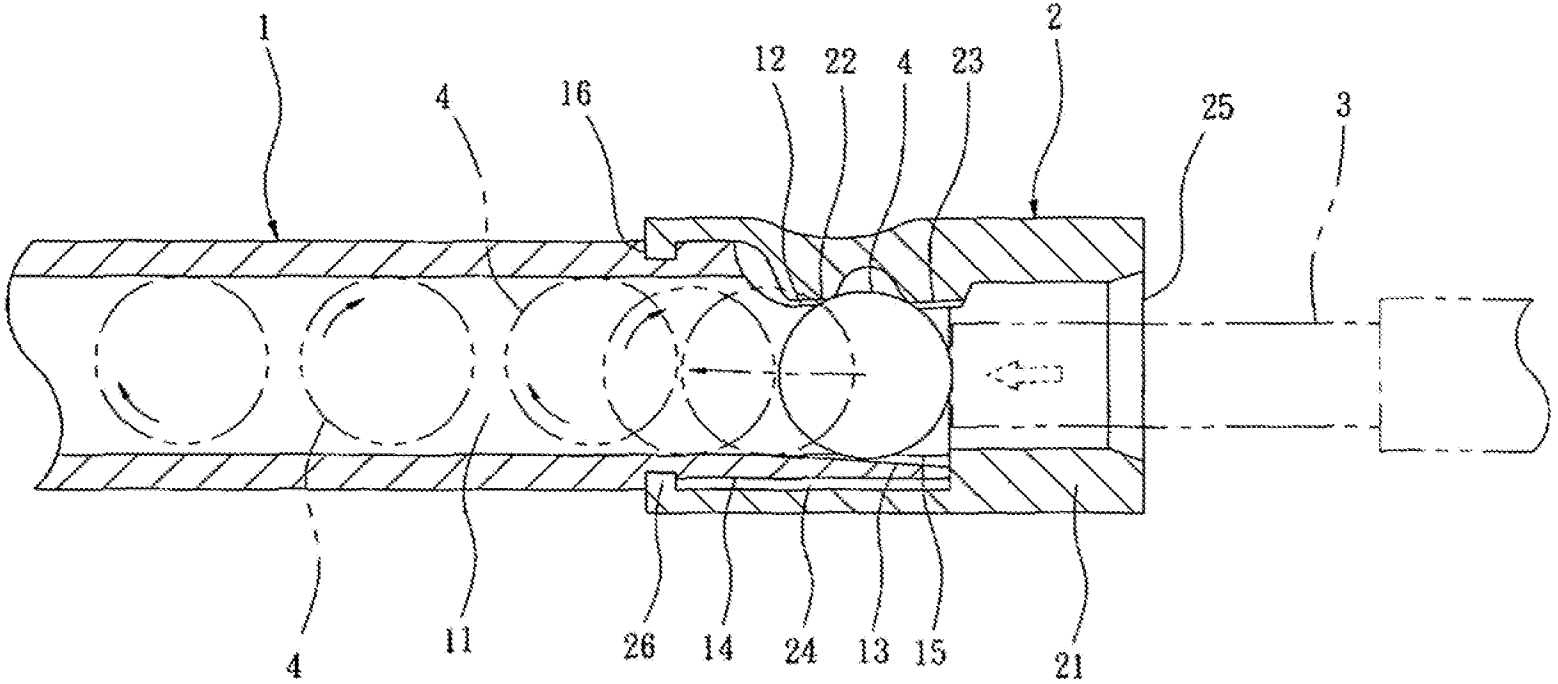
FIG. 8 is a schematic diagram of the feeding and positioning device for toy gun of the present invention while firing after feeding of FIG. 7.

Therefore, reference to FIG. 7, the bullet 4 is pushed into the bore 11 by the nozzle 3 and downwardly pressed by the friction portion 22 of the friction cylinder 2 and the positioning protrusion portion 23 so that the positioning protrusion portion 22 is inserted into the convex hole 12 and the bore 11 inwardly and then downwardly press a rear section of the bullet 4 adjacent to the first end of the barrel 1 and the friction portion 22 is controlled to slantwise press a front section of the bullet 4 opposite to the rear section. The bullet 4 may be precisely feeding with three-point guiding position to prevent the bullet 4 from skewed error, increase the rotation speed by its own axis (shown as in FIG. 8), and improve the range of firing, effective potential energy, and hit rate.

Figure 9:
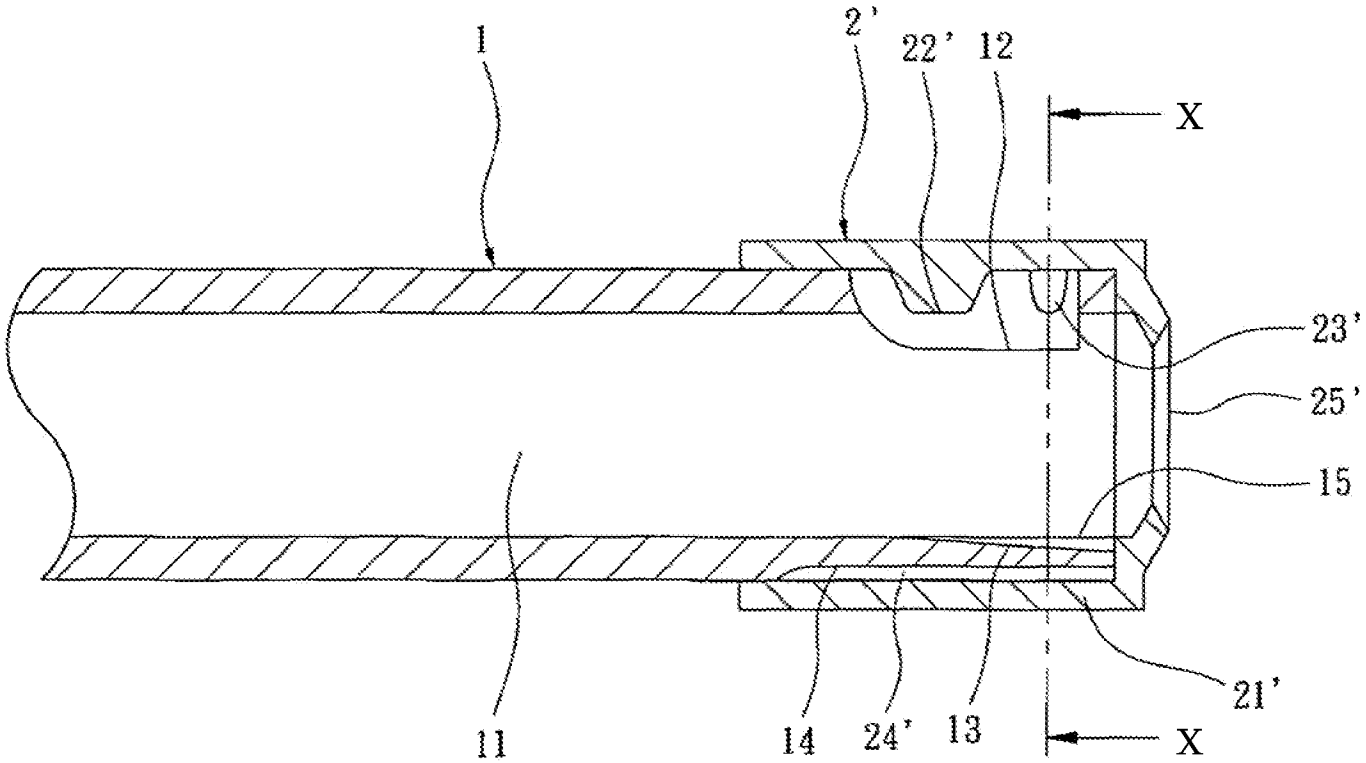
FIG. 9 is a structure diagram of another embodiment of the feeding and positioning device for toy gun of the present invention.
Figure 10:
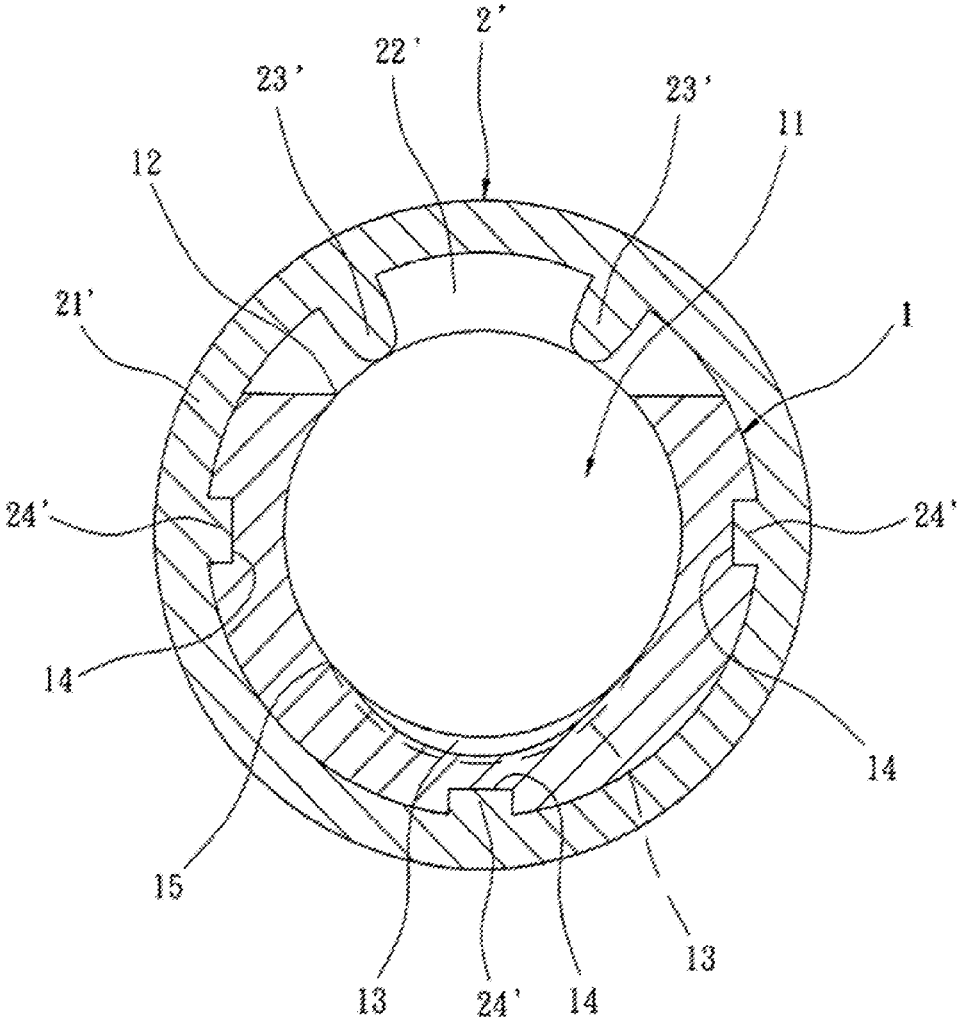
FIG. 10 is a cross-sectional view of FIG. 9 along line C-C.

Please refer to FIGS. 9 and 10, another embodiment of the feeding and positioning device may also comprise a barrel 1 and another friction cylinder 2' may have a hollow and elastic cylinder body 21' and a friction portion 22'. The cylinder body 21' may be covered at the first end of the barrel 1. The friction portion 22' may be arranged inside the cylinder portion 21 and inserted into the convex hole 12 of the barrel 1 inwardly and a plurality of embedding strings 24' may be arranged inside the friction cylinder 2 and corresponding to each embedding groove 14. A positioning protrusion portion 23' may be arranged between an inner portion of the friction cylinder 2 adjacent to the first end of the barrel 1 and the friction portion 22 so that the positioning protrusion portion 23' is inserted into the convex hole 12 and the bore 11 inwardly and two sides of the positioning protrusion portion 23' of the friction cylinder 2' are convex.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A bullet feeding and positioning device for toy gun, comprising:

a barrel, having a bore, a convex hole, and a guiding groove, two ends of the bore are communicated with each other and for guiding a bullet, the convex hole is arranged at a first end of an outer surface of the barrel and communicated with the bore, the guiding groove is convexly arranged at a bottom surface of the bore and axially extended, two groove sides are formed at two sides of the guiding groove, a width and a depth of the guiding groove are gradually decreased from the first end of the barrel inwardly so that the bullet is aligned by the groove sides of the guiding groove; and a friction cylinder, having a hollow and elastic cylinder body and a friction portion, the cylinder body is covered at the first end of the barrel, the friction portion is arranged inside the cylinder portion and inserted into the convex hole of the barrel inwardly so that the friction portion is controlled to press the bullet slantwise.

2. The device as claimed in claim 1, wherein a cross section of the guiding groove is arc shape.

3. The device as claimed in claim 1, wherein a positioning protrusion portion is arranged between an inner portion of the friction cylinder adjacent to the first end of the barrel and the friction portion, and the positioning protrusion portion is inserted into the convex hole and the bore inwardly so as to press the bullet downwardly.

4. The device as claimed in claim 3, wherein two sides of the positioning protrusion portion of the friction cylinder are convex.

5. The device as claimed in claim 1, wherein two embedding grooves are respectively arranged at an outer surface of two sides of the first end of the barrel and axially extended, and a plurality of embedding strings is arranged inside the friction cylinder and corresponding to each embedding groove.

6. The device as claimed in claim 5, wherein a radial ring groove is arranged at one end of each embedding groove opposite to the first end of the barrel, and an inner convex ring is arranged at the friction cylinder and corresponding to the radial ring groove.

* * * * *